US006773177B2

(12) United States Patent
Denoue et al.

(10) Patent No.: US 6,773,177 B2
(45) Date of Patent: Aug. 10, 2004

(54) METHOD AND SYSTEM FOR POSITION-AWARE FREEFORM PRINTING WITHIN A POSITION-SENSED AREA

(75) Inventors: Laurent Denoue, Palo Alto, CA (US); Lester D. Nelson, Santa Clara, CA (US); Elizabeth F. Churchill, San Francisco, CA (US); William N. Schilit, Menlo Park, CA (US); Gene Golovchinsky, Palo Alto, CA (US)

(73) Assignee: Fuji Xerox Co., Ltd., Tokyo (JP)

( * ) Notice: Subject to any disclaimer, the term of this patent is extended or adjusted under 35 U.S.C. 154(b) by 144 days.

(21) Appl. No.: 09/951,607

(22) Filed: Sep. 14, 2001

(65) Prior Publication Data

US 2003/0051615 A1 Mar. 20, 2003

(51) Int. Cl.[7] ..... B41J 3/36

(52) U.S. Cl. ..... 400/88; 345/179; 345/180; 346/143; 347/109; 358/473

(58) Field of Search ..... 400/88; 101/485, 101/486, 45; 345/179–183; 346/143; 358/471–478; 347/109

(56) References Cited

U.S. PATENT DOCUMENTS

| | | | | |
|---|---|---|---|---|
| 4,168,533 A | | 9/1979 | Schwartz | 364/900 |
| 4,523,235 A | | 6/1985 | Rajchman | 358/256 |
| 4,857,955 A | * | 8/1989 | Crandall | 358/1.9 |
| 4,915,027 A | | 4/1990 | Ishibashi et al. | 101/486 |
| 4,949,283 A | | 8/1990 | Yamauchi et al. | 364/519 |
| 5,311,208 A | | 5/1994 | Burger et al. | 345/163 |
| 5,446,559 A | * | 8/1995 | Birk | 358/473 |
| 5,578,813 A | | 11/1996 | Allen et al. | 250/208.1 |
| 5,593,236 A | | 1/1997 | Bobry | 400/88 |
| 5,842,793 A | | 12/1998 | Katayama et al. | 400/88 |
| 5,861,877 A | * | 1/1999 | Kagayama et al. | 345/179 |
| 5,927,872 A | | 7/1999 | Yamada | 400/88 |
| 6,312,124 B1 | * | 11/2001 | Desormeaux | 347/109 |
| 6,517,266 B2 | * | 2/2003 | Saund | 400/88 |

* cited by examiner

*Primary Examiner*—Minh H Chau
(74) *Attorney, Agent, or Firm*—Oliff & Berridge, PLC

(57) ABSTRACT

A method and system for position-aware freeform printing in which a source image space in a source medium and a target image space in a target medium are specified. A selected image in the source image space is copied and/or optionally processed and transferred to the target image space. A controller captures the selected source image and stores the image in a memory. The image is optionally processed and the processed and optionally formatted image is output. The controller may format the processed image to fit into the target image space by controlling the rendering of the processed image onto the target medium as the printing device is moved over the target image space in a freeform direction. The controller predicts the freeform direction that the print head will travel by detecting the motion previously traveled and adjusting the image to compensate for the predicted freeform direction.

49 Claims, 10 Drawing Sheets

| TARGET / SOURCE | PHYSICAL | DIGITAL |
|---|---|---|
| PHYSICAL | PHOTO-COPY | SCAN |
| DIGITAL | PRINT | COPY-AND-PASTE |

FIG. 5

| SOURCE | INTERMEDIATE | TARGET | OPERATION |
|---|---|---|---|
| REPRESENTATION 1 → | REPRESENTATION 1 → | REPRESENTATION 1 | COPY/PASTE |
| REPRESENTATION 1, ...REPRESENTATION N → | REPRESENTATION 1, ...REPRESENTATION N → | REPRESENTATION 1, ...REPRESENTATION N | SEQUENCING |
| REPRESENTATION 1 TRANSFORM → | REPRESENTATION 1* → | REPRESENTATION 1* | TRANSFORM |
| REPRESENTATION 1 TRANSFORM → | REPRESENTATION 1* TRANSFORM → | REPRESENTATION 1** | |
| REPRESENTATION 1, → | TRANSFORM REPRESENTATION 1, ...REPRESENTATION N → | REPRESENTATION 1, ...REPRESENTATION N | SEGMENT |
| REPRESENTATION 1, ...REPRESENTATION N → | TRANSFORM REPRESENTATION 1* → | REPRESENTATION 1* | AGGREGATE |

FIG. 6

METHOD AND SYSTEM FOR POSITION-AWARE FREEFORM PRINTING WITHIN A POSITION-SENSED AREA

BACKGROUND OF THE INVENTION

1. Field of Invention

This invention relates generally to methods and systems for position-aware freeform printing. This invention also relates to methods and systems for position-aware freeform printing, in which digital content is captured and printed by manually operating a printing device over the surface of a target image space of a target medium in a position-sensed coordinate system.

2. Description of Related Art

Conventionally, people use three modes to print information: 1) writing the information out manually with a writing instrument; 2) printing the information onto a label; or 3) printing the information on a piece of paper fed through a traditional printer. These modes have limitations. First, manually transcribing information can be slow, error prone. For example, writing an email address, product reference number or a Web Page address is error prone since each character is significant. Moreover, manual transcription is not always suitable for all kinds of information. For example official forms, special characters, and/or graphical information like logos or pictures are difficult to manually transcribe. Printing information onto a label can present formatting problems. Generally, labels are of a predetermined size and may require trimming or adjustment of the label in order to fit the relevant information into a predetermined area on the label. Furthermore, extra work is required to affix the label. Third, conventional printers often seem inappropriate and inefficient when printing out small bits of information onto small portions of a page. In addition, conventional printers are limited to printing only onto a surface that can be fed into the printer. Also, the particular types of surface that the conventional printer can print onto is also limited. In particular, surfaces cannot easily be fed into a printer, such as, an agenda, a box, a Post-It® style paper, while other surfaces cannot be fed into a printer at all.

Conventional printers cannot distinguish a preexisting image or preexisting markings on a piece of paper that is fed into the printer. Thus, conventional printers will non-discriminately print over preexisting images. Therefore, it is difficult for a printer to direct new print information into blank areas on a surface having preexisting information. For example, adding an item to a preprinted agenda or preprinted to do list is difficult using conventional printers.

Numerous small hand held printers have been developed to print textual data information, such as the address on an envelope. These conventional hand held printers use optical and mechanical methods for controlling printing at a location. The conventional mechanical hand held printers integrate mechanical sensors to print the data information as the user manually moves the printer over a surface. However, these conventional mechanical hand held printers suffer from numerous disadvantages. In some mechanical hand held printers, rollers limit the movement of the printer to a direction perpendicular to the print head by friction that is applied against the surface of the print media. In addition, the mechanical sensors used in these conventional mechanical hand-held printers are not always accurate on the sliding surfaces.

Conventional free-hand image scanning use optical sensors like the optical sensor, used in the Microsoft Intellimouse® and described in U.S. Pat. No. 5,578,813. Although optical sensors are better suited for tracking the position of the printer, they tend to be complicated and very sensitive to dust or paper handling.

Also these conventional mechanical and optical sensing techniques are limited to providing an absolute position of the printer, relative to a starting point of the print head. Therefore, if a user lifts the printer from the media it is printing on, the position of the printer is misaligned.

Other conventional hand held printers having optical sensors, such as those disclosed in U.S. Pat. No. 5,927,872, use optical sensors for tracking positions of the hand held printer relative to the surface of a print medium during the printing process. In these conventional hand held printers the print head can move in two dimensions and print bitmaps that are bigger than the print head width. Although, these conventional hand held printers can move in two dimensions, only relative positioning is supported. Thus, once the conventional hand held printers are lifted from the printing surface, the position of the print head relative to the last print position is disrupted.

Conventional hand held printers are limited in that data information is printed in a single pass, assuming that the print head is wide enough to print the desired data information. In other conventional hand held printers such as the conventional hand held printer in U.S. Pat. No. 5,988,900, a hand held sweep electronic printer is provided with compensation for non-linear movement. However, any slight augmentation of the print head width disrupts the alignment positioning of the hand held printer.

U.S. Pat. No. 5,842,793, describes a hand held printer having a small LCD screen that displays the print length of the data information. This printer scales the data information according to a specified value. If the data information is textual, the printer can reformat the original content by splitting it among several lines and reducing the font size. If necessary, a user can increase or decrease the display length value. In other modes, the user can also drag the hand held printer without printing to view what data information, such as text is to be printed. Although a user can increase or decrease the display length, it is still not possible for the user to specify the dimensions of the printed area.

Various image processing techniques that reformat data information to fit within a new area are applied in imaging software like Photoshop® and Adobe Illustrator® and the Casio Copy Pen®. However, it is not possible to warp text along an arbitrary path using these conventional techniques.

SUMMARY OF THE INVENTION

Systems and methods according to this invention provide for position-aware freeform printing. The systems and methods according to this invention provide for printing ad-hoc, informal, situation specific data information onto the surface of a print media including surfaces that cannot be fed into a conventional paper fed printer.

One aspect of the invention is to provide a method for position-aware freeform printing that includes selecting and capturing an image from a source image space with a printing device. A target image space is defined on the target surface using the freeform printer in a non-printing mode. The content of the image is then rendered into the target image space of a target medium by moving the printer in a freeform manner. For example, a freeform manner is a motion that involves moving the printing device with respect to the printable surface. Further, the motion the user takes in moving the printing device is not constrained to a particular location or to a particular orientation of the printing device to the printable surface.

Various embodiments according to this invention provide a system for position-aware freeform printing that includes a source medium with a source image space and a target medium with a target image space. A printing device selects an image from the source image space of the source medium and specifies a target image space on a target medium and transfers a processed image to the target image space. A controller captures the image selected by the printing device and stores the image in a memory. The image selected by the printing device is processed and a processed image is output. The controller formats the processed image to fit into the target image space by controlling the rendering of the processed image onto the target medium based on position information from a position sensing device when the printing device is moved over the target image space in a freeform direction. For example, a back and forth rubbing or brush-like motion may be used. The controller predicts a freeform direction that the print head will travel by detecting the motion previously traveled and adjusting the print image to compensate for the predicted freeform direction.

In various other exemplary embodiments according to this invention, the captured print image may be processed so that it can be pasted within a print target area. Processing may include, but is not limited to aggregation, segmentation, and transformation of the print image.

The systems and methods according to this invention provide for position-aware freeform printing, in which digital data information, such as an image or text, is printed by operating a printing device over the surface of a target area image space that is placed in a position-sensed coordinate system, or position sensing device. In particular, digital content is printed by operating a printing device, such as, a position-aware freeform printing hand held printer or any other known or later developed type of printing device, over output material situated in the position-sensed coordinate system. The methods and systems for position-aware freeform printing are designed to print ad-hoc, informal, situation-specific data information, such as, phone numbers, reference numbers, URL's, and any other type of data information, onto a target medium. For example, Post-It® style paper, notebooks, whiteboard, or any other target medium can be printed on in accordance with the systems and methods according to this invention. In another exemplary embodiment according to this invention, the position-aware freeform printing system senses the location of the print head of the printing device. For example, a touch screen, a touch pad, a whiteboard position sensor or any other method of verifying position information may be used in the practice of this invention.

Interfaces for applying emphasis in print, and for Z-axis printing or graphic layering so that the freeform printing occurs in a selected Z-axis of stored print images, and registration marking for data information capture, metadata management, and to provide real-time image processing are also provided by this invention.

BRIEF DESCRIPTION OF THE DRAWINGS

Various exemplary embodiments of this invention are described in detail with reference to the following figures, where like numerals reference like elements, and wherein:

FIG. 5 shows a copy-and-paste diagram according to this invention;

FIG. 6 shows the processing of data information in accordance with exemplary classes for freeform printing according to this invention;

DETAILED DESCRIPTION OF EXEMPLARY EMBODIMENTS

In accordance with this invention, data information can include, for example, images, text, or any other known or later developed data information.

Figure 1:
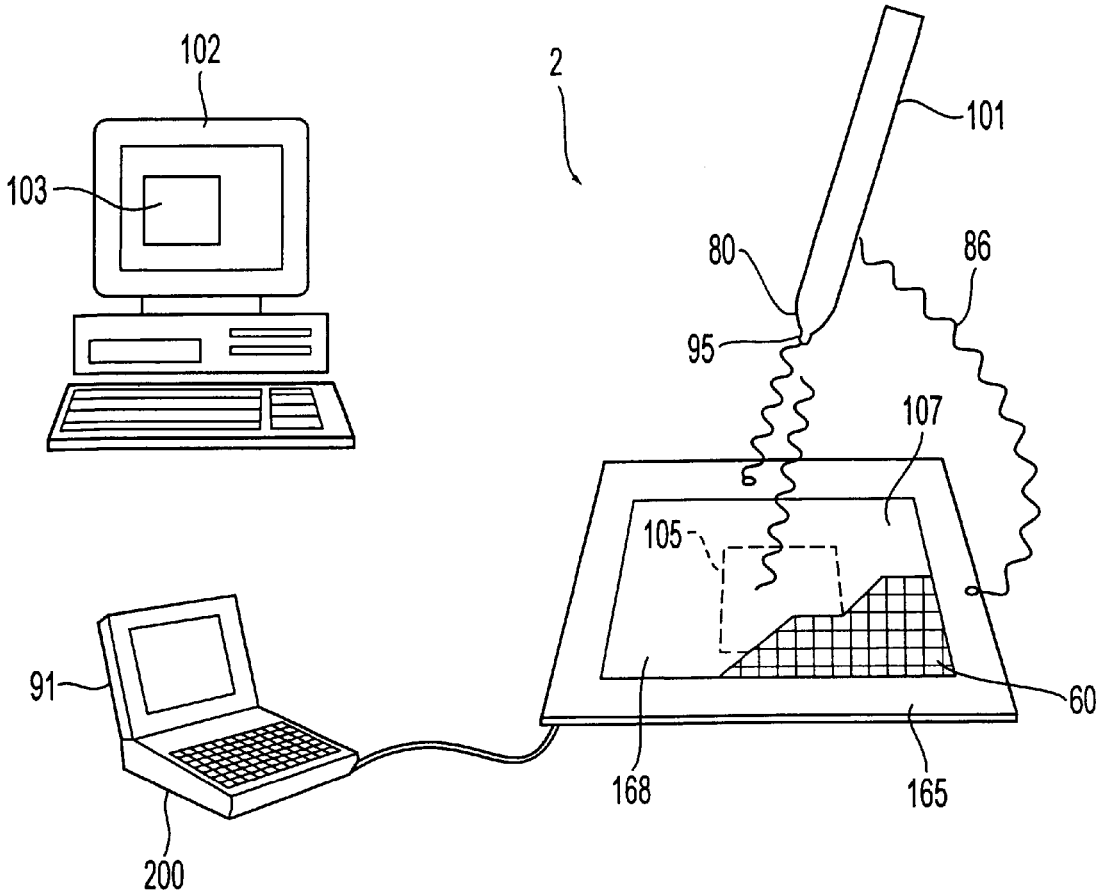
FIG. 1 shows a first embodiment of a position-aware freeform printing system in accordance with this invention.
Figure 2A:
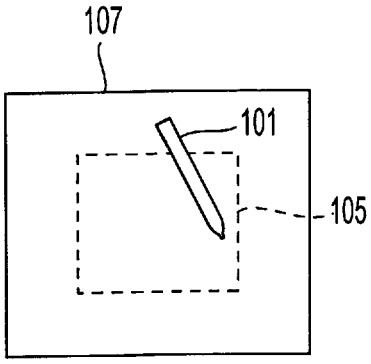
FIGS. 2A–2F shows a freeform motion of the printing device of a position-aware freeform printing system that builds up a printed image in the first exemplary embodiment according to this invention.
Figure 2B:
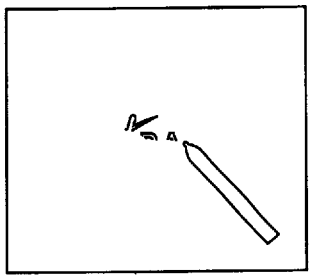
Figure 2C:
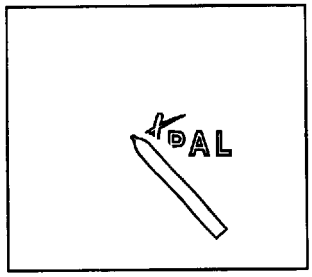
Figure 2D:
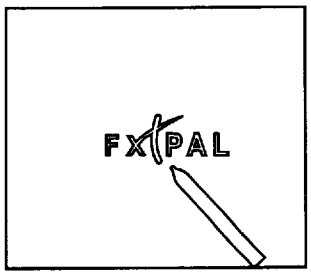
Figure 2E:
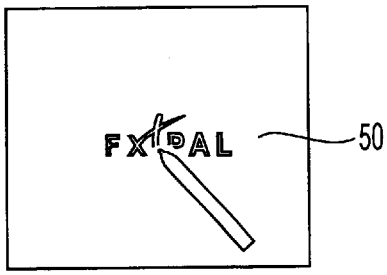
Figure 2F:
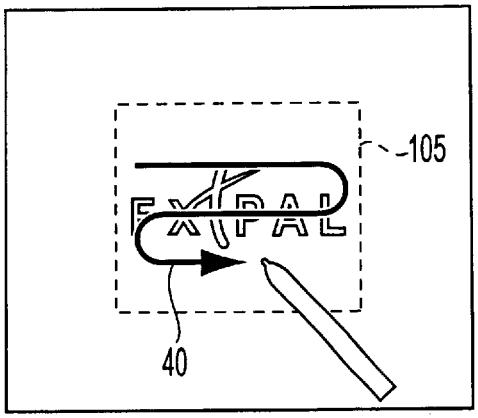

FIG. 1 shows a first embodiment of a position-aware freeform printing system 2 in accordance with the present invention. In this embodiment, the position-aware freeform printing system 2 includes a source image space 103 on a source medium 102, a printing device 101, a position sensing device 165, a target image space 105 on a target medium 107 and a controller 200.

In a non-printing mode, the printing device 101 defines a source image space 103 on the source medium 102 from which an image is selected and which is captured by the controller 200. A target image space 105 on the target medium 107 is defined into which the image will be printed. The controller 200 processes and formats the image to fit into the target image space 105. The rendering of the image onto the target medium is controlled while the target medium 107 is positioned within a position sensing area 168 of the position sensing device 165. When the printing device 101 is moved over the target image space 105 in a freeform motion, the controller 200 determines the freeform direction that the printing device 101 travels. For real time text warping, the controller 200 predicts the freeform direction that the printing device 101 travels.

In particular, FIG. 1 shows an electromagnetic location position sensing device according to the position-aware freeform printing system 2. A freeform print head 95 is located in a printing device 101. The printing device 101 produces a signal 86 to a position sensing device 165, or location tablet. In various exemplary embodiments according to this invention, the position of the printing device 101 may be sensed passively, the printing device may transmit a signal based on location or may use any other known or later developed method of determining position. Accelerometers (not shown) may be placed in the printing device 101 to detect the orientation of the freeform print head 95. The target medium 107 is placed on the magnetic tablet 60 for printing thereon. In this embodiment, processing occurs in the controller 200 of the connected computer 91. The connected computer 91 can include, but is not limited to, a laptop, a palmtop, a PDA, etc.

FIGS. 2A–2F illustrate the freeform motion of a printing device 101 over a target image space 105 of a target medium 107. As the user gradually moves the printing device 101 in a freeform motion 40, the image 50 is gradually printed onto the target medium 107. The gradual freeform motion 40 traversed in this embodiment is similar to a back and forth brush-like or rubbing motion.

Figure 3:
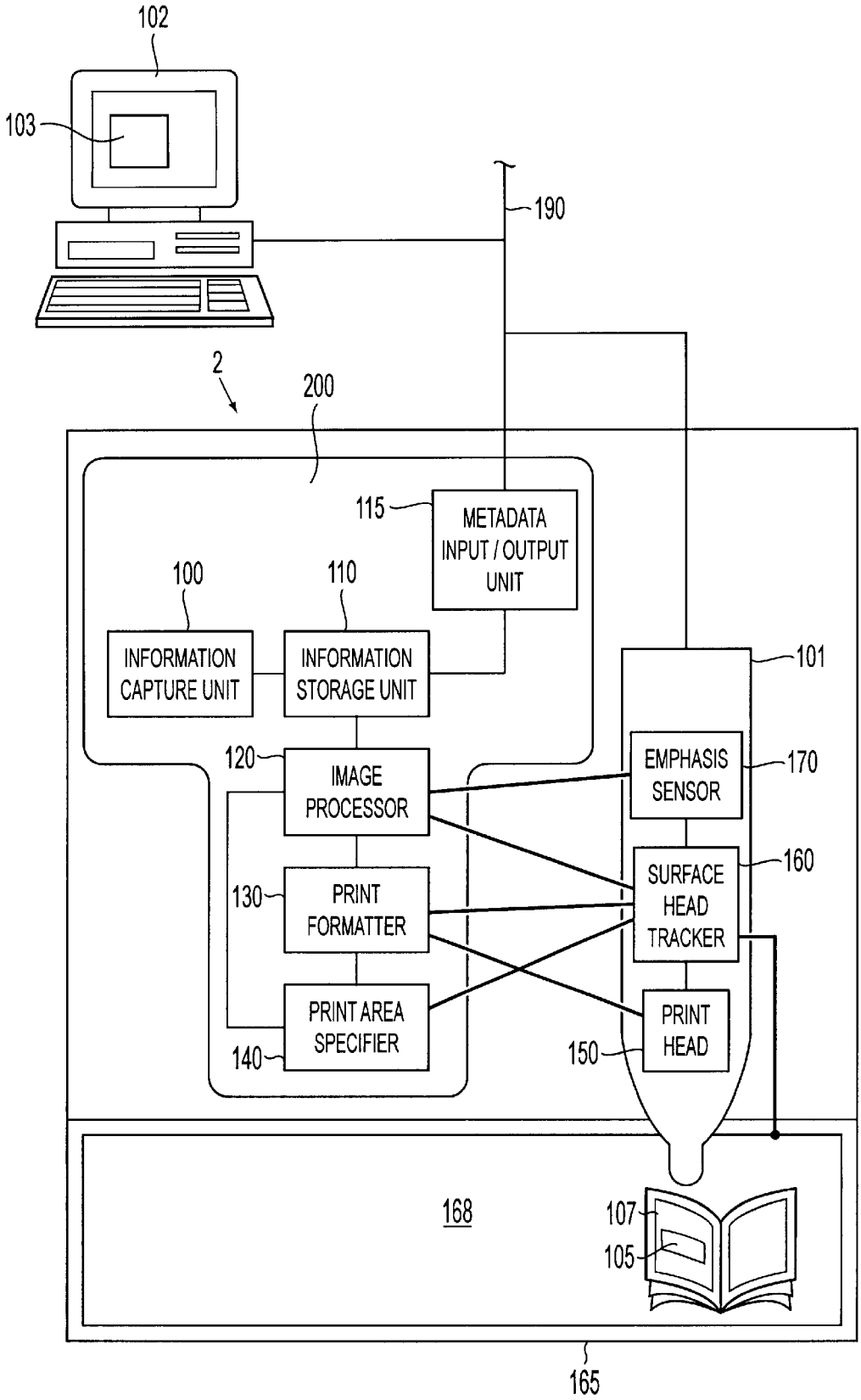
FIG. 3 shows a general construction of the position-aware freeform printing system in accordance with the present invention.

FIG. 3 shows an exemplary position-aware freeform printing system 2 according to this invention. The position-aware freeform printing system 2 includes a printing device 101, a position sensing device 165 and a controller 200. According to a first exemplary embodiment of this invention, the printing device 101 includes a surface head tracker 160, an emphasis sensor 170 and a print head 150 connected to communications link 190. The controller 200 includes circuitry for: an information capture unit 100, an information storage unit 110, a metadata input/output unit 115, an image processor 120, a print formatter 130 and a print area specifier 140. The position sensing device 165 includes circuitry for a position sensing area 168. In this exemplary embodiment, the position-aware freeform printing system 2 transfers data information from a source image space 103 on a source medium 102 to a target image space 105 on a target medium 107 while the target medium 107 is positioned within the position sensing area 168 of the position sensing device 165. Although FIG. 3 shows a computer as a source medium 102 and a notebook as the target medium 107, the source medium 102 and the target medium 107 are not intended to be limited to these mediums and may include any other known or later developed medium for use in accordance with the present invention.

In a non-printing mode, the printing device 101 defines a source image space 103 on a source medium 102. The source image space 103 is a dimensional area from which data information is retrieved by the controller 200.

In the controller 200, the data information is captured by an information capture unit 100 and stored in an information storage unit 110. The information storage unit 110 can also receive input from the metadata input/output unit 115. The metadata input/output unit 115 associates properties with the metadata. Example properties that can be included in metadata include, the digital content of the data information itself such as a dataglyph encoding binary image data, the date, the time, the link to the source from where the content was selected, or any other known or later developed type of data information. In various other exemplary embodiments, according to this invention, controller 200 may store the source image space 103 display area of source medium 102, may scan the source image space 103 into a memory or process the data information using any other known or later developed method.

The printing device 101 defines a target image space 105 on a target medium 107 that is positioned within the position sensing area 168 of the position sensing device 165. The target image space 105 can be defined in a number of different ways. In one example, the dimension of the target image space 105 can be defined by a freeform shape that is outlined by the printing device 101. In another example, the captured data information is printed along a freeform path traced by the printing device 101. The dimension of the target image space 105 is specified by the movement of the printing device 101 over the target medium 107 while the target medium 107 is positioned over the position sensing area 168. The motion of the printing device 101 in the area defined by the print area specifier 140 is tracked by a surface head tracker 160 in conjunction with the position sensing device 165.

The image processor 120, retrieves the stored data information received from the information storage unit 110. The image processor 120 performs various processing operations such as copying, sequencing, transferring, segmenting, aggregating or any other known or later developed technique of processing the image. The data information is received in the image processor 120 via communications link 190 from the information storage unit 110, the emphasis sensor 170, the print area specifier 140, and the surface head tracker 160. However, it will be apparent that any method of transferring the data information may be used in the practice of this invention.

The emphasis sensor 170 emphasizes a portion or all of the captured data information. The print area specifier 140 receives position information from the surface head tracker 160 over communications link 190 to determine where the print data information is to be printed in the target image space 105. The surface head tracker 160 and the position sensing device 165 track the freeform motion of the print head by communicating current position information from the surface head tracker 160 and current information from the position sensing area 168.

The print information is then sent from the image processor 120 to the print formatter 130 where the print information is formatted to fit within the dimensions of the target image space 105. The print formatter 130 receives information from the image processor 120 and based on information from the surface head tracker 160, sends formatted print information to the print head 150.

In a printing mode, the printing device 101 prints the formatted print data information onto the target image space 105 of the target medium 107 as the printing device 101 is moved over the target image space 105 in a freeform motion. The controller determines the movement of the printing device 101 with sufficient certainty that the formatted print data information is not skewed and the image is correctly reproduced. For real time text warping, the controller 200 predicts the freeform direction that the printing device travels.

Figure 9:
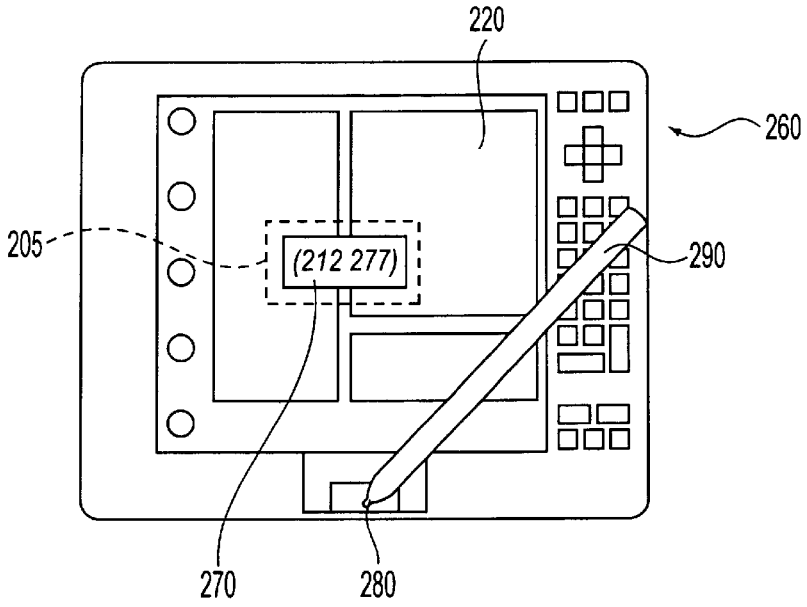
FIG. 9 shows an exemplary embodiment of a touch screen position-aware freeform printing system in accordance with this invention.
Figure 10:
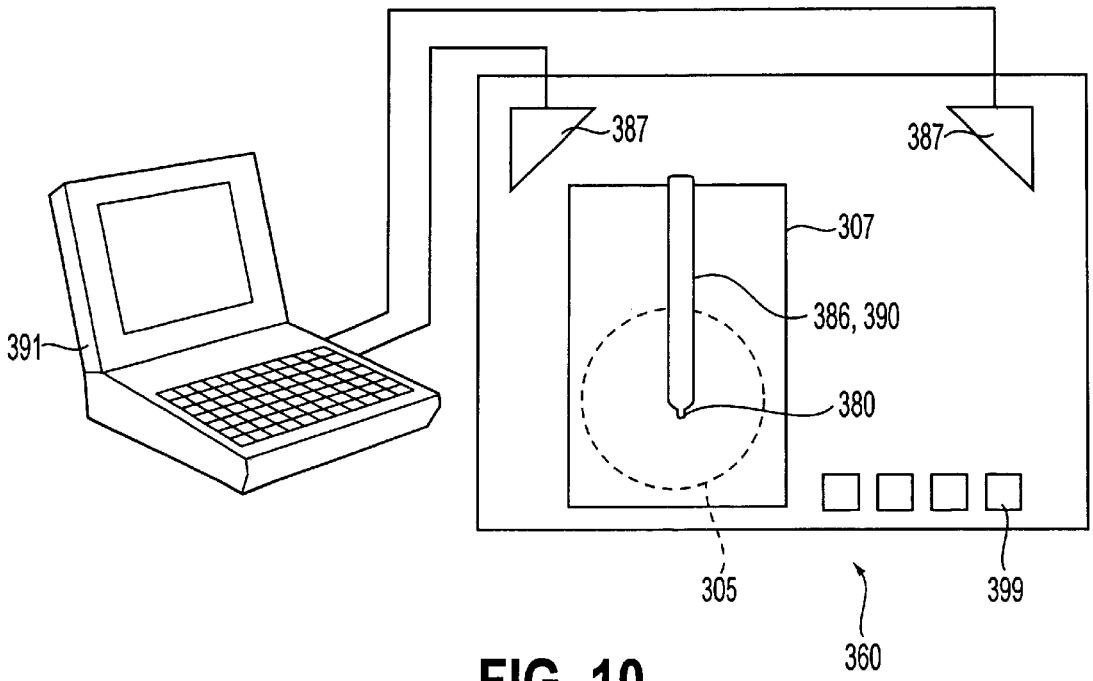
FIG. 10 shows an exemplary embodiment for a whiteboard marking position-aware freeform printing system in accordance with this invention.

The components which make up the position-aware freeform printing system 2 can have a number of different constructions. For example, in FIG. 1, the controller 200, may be contained in an externally connected computer 91, the surface head tracker 160 and the print area specifier 140 may be contained in the position sensing device 165 and the emphasis sensor 170 and the print head 150 are contained in the printing device 101. The touch screen device 260 and the whiteboard marking system 360, as shown in FIGS. 9 and 10 respectively, illustrate various other alternative constructions for the components that make up the position-aware freeform printing system 2.

Figure 4:
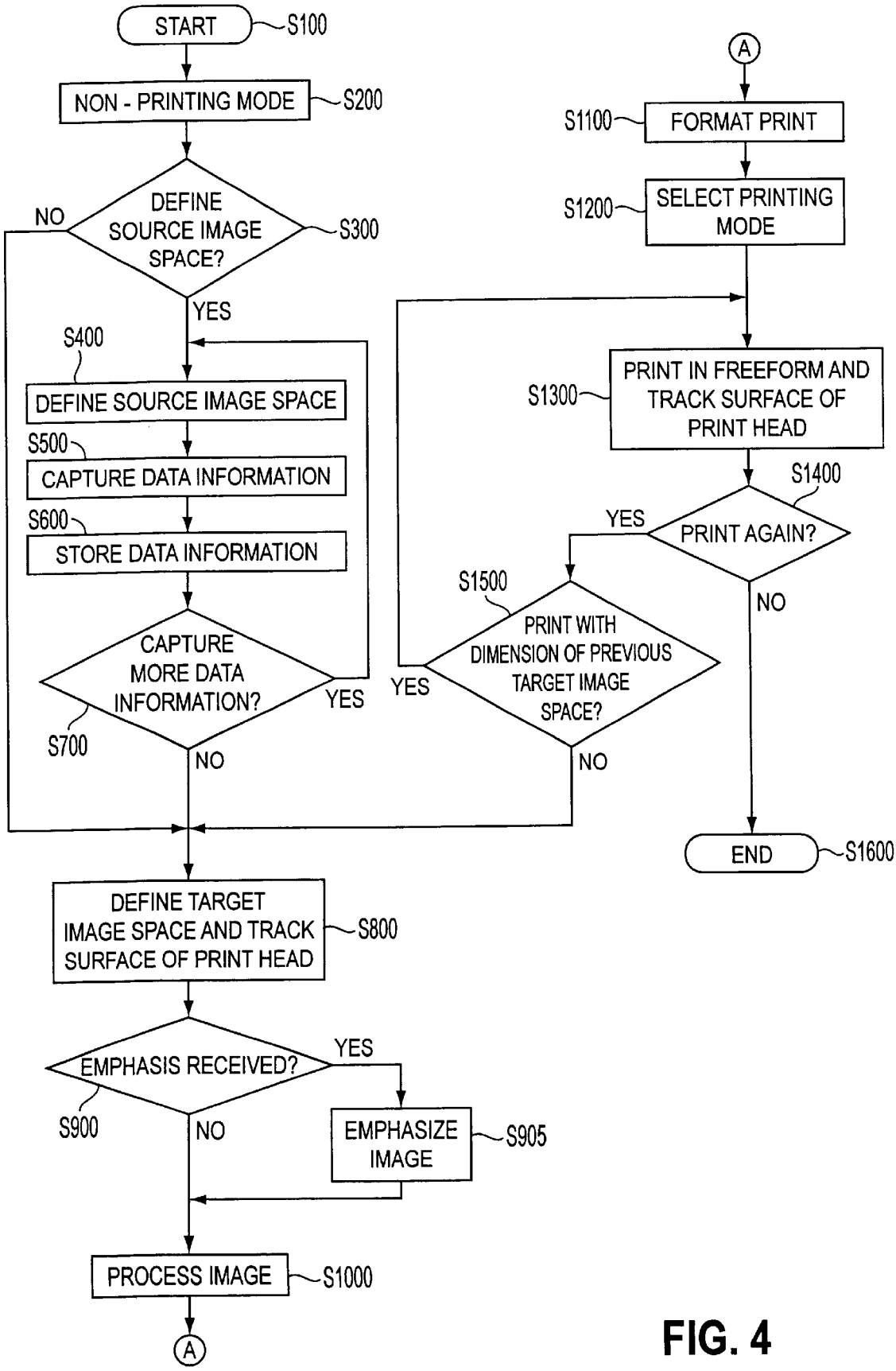
FIG. 4 shows an exemplary process for the position-aware freeform printing system in accordance with this invention.

FIG. 4 shows an exemplary method for position-aware freeform printing in accordance with the present invention.

In particular, a control routine begins in step S100. The control routine continues to step S200, where a non-printing mode is selected. The nonprinting mode can be selected directly, such as with a button, an icon on a touch screen and/or or any other known or later developed method of selection. Alternatively, in various embodiments according to this invention, the non-printing mode could be the default mode before printing. After the target image space is defined, a printing-mode may be automatically selected. In various other exemplary embodiments according to this invention, a LCD may be used to indicate the current mode to a user. In the non-printing mode, data information can be selected from a source image space 103 on a source medium 102. The data information can include, for example, images, text, or any other known or later developed type of data information. The source medium 102 can also be selected from a physical medium such as for example, paper, notebooks, or any other known or later developed physical medium and digital medium such as, a computer screen, palm computers, or any other known or later developed medium. The control routine then continues to step S300.

In step S300, the control routine determines whether to define a source image space. It may not be necessary to define a source image space if the data information has previously been stored in an information store. If it is not necessary to define the source image space, then control continues to step S800. Otherwise control continues to step S400.

In step 400, a source image space is defined on a source medium. The source image space identifies the desired data information that is to be transferred. Various exemplary modes can be used to identify the source image space on the source medium. For example, a rectangle drawn around the source image space, a circle, an underline, a line, clicking and dragging a cursor over source image space, a dot-to-dot selection of a source image space, defining a freeform shape that defines the source image space, or any other known or later developed type of identification may be used in the practice of this invention. The control routine then continues to step S500.

In step S500, the data information that is defined within the source image space is captured. In various other exemplary embodiments according to this invention, the data information may be captured using a software layer, a CCD camera, interaction with a PC, PDA, cell phone, scanner, display, or any other known or later developed mode for capturing data information. The control routine then continues to step S600. In step S600, the captured data information is stored. In various exemplary embodiments according to this invention, the storage information may include, local or server-based databases or files, memory cards, or any other known or later developed type of information storage. The control routine then continues to step S700.

In step S700, a determination is made whether to capture additional data information. If so, control returns to step S400. Otherwise, control continues to step S800.

In step S800, a target image space is defined on a target medium. The print head of the printing device is tracked as the target image space is defined over the surface of the target medium. The target image space may be defined on the target medium using various exemplary indicators. For example, drawing a circle, a rectangle, drawing a freeform line, a dot-to-dot orientation, dragging and clicking a cursor, drawing a freeform shape, or any other known or later developed method for defining areas may be used. The target medium may include a variety of targets, such as, a notebook, a PostIt®, a diary, or any other known or later developed medium for printing thereon. Control continues to step S900.

In step S900, the control routine determines whether emphasis information has been received by an emphasis sensor. The emphasis information may also be received from a button push allowing a user to emphasize an image. If emphasis information has been received, control continues to step S905 and the image is emphasized. For example, the image may be emphasized by, bolding, underlining or any other method of emphasizing the image. Control then continues to step S100.

f a determination is made that no emphasis information has been received, control continues to step S1000. Various other exemplary types of emphasis may include circling, underlining, highlighting, or any other known or later developed mode for indicating emphasis information.

In step S1000, the image is processed. For example, copy/paste, sequencing, single transformation, multiple transformations, aggregation, Z-axis printing, metadata rendering, formatting, warping, a combination of any of the previously mentioned modes or any other known or later developed image processing is completed. Control continues to step S1100.

In step S1100, the control routine determines whether to format the image. For example, formatting can depend on whether the dimension of the target image space has been modified and/or is different from the dimension of the source image space. If the dimension of the target image space is smaller than the dimension of the source image space, the height and width of the captured image may be modified to fit within the dimension of the target image space. Control then continues to step S1200.

In step S1200, the printing mode is selected. By selecting the printing mode, printing to the target image space is enabled. Control continues to step S1300.

In step S1300, the data information is printed onto the target image space as the printing device is moved in a freeform motion over the target medium, which was placed over the position sensing area. In accordance with the invention, the direction of the printing motion can be determined with sufficient certainty to render the data information. Control continues to step S1400.

In step S1400, the control routine determines whether a request to print again has been indicated. If not, the control routine continues to step S11600 and the control routine is terminated. If an instruction to print has been requested, control continues to step S1500.

In step S1500, the control routine determines whether the dimension of the new target image space is the same or different from the dimension of the previous target image space printed in step S1300. If so, control returns to step S1300. Otherwise, the control returns to step S800. Steps 1300–1400 are repeated until a determination is made in step S1400 that no printing again request has been received. Control then continues to step S1600 and the process ends.

In various exemplary embodiments, the target image space may be defined on a target medium while the target medium is positioned over a position sensing device and the print head of the printing device is tracked as the target image space is defined over the surface of the target medium.

In accordance with this invention, various aspects of the method and apparatus of the position-aware freeform printing system 2 will be described in more detail.

FIG. 5 shows a copy-and-paste diagram in according to this invention. People often access data information in one place and desire to paste it to another place that is more appropriate to their needs. In FIG. 5, the position-aware freeform printing system 2 provides "copy and paste" capabilities that allow a person to easily capture and print digital content while engaged in situations where interaction with a standard-feed plain paper printer is not convenient. For example, in freeform printing, a user may operate a printing device 101, such as a printing pen, over a target medium, such as a notebook, an envelope, a whiteboard, a Post-It® style paper, personal diary, or any other type of target medium now known or later-developed in a manner that is not constrained by how the printer is moved. For example, the user can rub the printing device back and forth over the paper notebook.

The term "data motion" is used to describe the process of moving data information bits from one place and pasting them into another. Some examples of data motion include: copying data information bits from one computer application and pasting them into another application; reading data information bits from a computer screen and printing them out for later use; reading data information bits from a computer screen and manually transcribing the data information and listening to information and then writing down the data information of interest. For example, listening to an advertisement and then writing down the sales agent's telephone number.

FIG. 6 shows three representations of data information that may be incorporated into five exemplary usage operations in accordance with the position-aware freeform printing system 2. The three representations include, sources that may be physical or digital data information, target physical representations and internal digital representations of the source. The five usage operations include, copy and pasting, sequencing, transforming, segmenting and aggregating or any other processing of the data information. Five types of usage situations are defined by the kinds of transformations made on the representations and at what point the user is aware of and manipulates these transformations such as, by adjusting the printer controls.

The first row shows a copying and pasting operation which is the simplest form of a data motion for the user. Data information is simply lifted from one place, such as a computer monitor or printed page, and printed elsewhere, such as a notebook.

In the operation, data information is captured in a copy/paste operation in storage as an intermediate Representation 1. In various other exemplary embodiments according to this invention, the data information can be stored in the memory of a computer or in a printing device equipped with memory. Since no processing of the image occurs, the data information that is to be printed to a target medium is also shown as Representation 1.

For example, if a user desires to apply a "Coke" logo to a Post-it ® style, paper, the "Coke" logo is source Representation 1. The "Coke" logo is then stored in an intermediate stage Representation 1 in the memory of a computer or in the memory of a printing device. When the printing mode is selected and the printing device is moved over the target image space 105, the source Representation 1 is printed exactly the same as the initially scanned or copied logo. No transformation is applied to the logo. The source Representation 1 is merely copied and pasted from a source image space 103 to a target.

Alternately, a customer browsing Web ads finds a product of interest, the customer highlights the data information, capturing the data information into the printing device 101. The data information content is then printed to the customer's own paper notebook for later reference by designating a target image space and moving the printing device 101 over the designated print area.

In various other exemplary embodiments according to this invention, a handwritten phone list pasted to an office wall can be updated by selectively copying some of the numbers.

The customer browsing the Web may highlight various features relating to a vehicle of interest, for example, a car model, number of miles, phone number, number of doors, color, year, and then may designate a print area in a notebook and print out the data information. The customer can also print a thumbnail picture of the car provided in the Web advertisement.

Alternatively, a user may desire to print parts of graphics, such as, clothes designs, logos, etc, or may have a need to reproduce one or more names and addresses onto envelopes.

In accordance with another aspect of the invention, the copied data information may be pasted many times until it is eventually overwritten with newly copied data information such as data information copied from a single item clipboard. Using this "single copy/repeat paste" model interesting pieces of data information selected from one medium could be pasted to another medium. For example, a customer browsing Web ads for wines of the world selects, copies and pastes the Web ad to a paper notebook, a Post-It® style paper, a postcard or any other medium.

Another example of repeated copy-and-paste iterations could include a car dealer copying the data information of a car plate number from a source image space 103 on a computer screen onto a target image space 105 of a paper. Several screens later, the car dealer copies this same data information from the source image space 103 in the paper into a target image space 105 in the computer.

As shown in FIG. 6, a second freeform printing usage situation is "sequencing" of the data information. Different copy operations may be chained or items stored in a stack and then printed one at a time.

In the sequencing operation, data information is captured as Representation 1 to Representation N where N is some number greater than 1. The data information is stored in memory in an intermediate stage as Representation 1 . . . Representation N. When the data information is to be printed to the target medium, the data information is printed sequentially as Representation 1 . . . Representation N.

For example, suppose a user desires to capture numerous sources, such as, a "Coke" logo, a "Pepsi" logo and a "Sprite" logo for printing to a target medium. The "Coke" logo, the "Pepsi" logo and the "Sprite" logo would be represented as Representation 1 . . . Representation N, etc. The logos are stored as Representation 1 . . . Representation N in an intermediate stage. When the printing device is moved over the target image space in a printing mode, the data information will be sent to the printing device as Representation 1 . . . Representation N. It is unnecessary to print each logo after each one is scanned. The method by which the data information is to be printed is flexible and can include, for example, one at a time, first in-first out, last in-first out, printing or any other known or later developed method of printing. Various exemplary embodiments according to this invention may provide for capturing a number of interesting wines from an extensive selection in a restaurant menu for later reference and printing into a notebook when a user gets home. Similarly, a number of phone numbers from a stack of business cards are copied, individually in an organized sequence until they are all recorded. These phone numbers may then be printed onto a single sheet in the organized sequence for quick reference and can be posted to an office wall.

As shown in FIG. 6, a third freeform printing usage situation is "transformation." Source data information may be converted and stored as a representation different from the original representation captured by the position-aware freeform printing system 2 after it is captured. For example, the representation may be translated and the representation segmented to fit the representation specified by the user in a non-printing mode.

In the third transform operation, two different variations for the transform can take place. In the first variation, data information is captured as Representation 1. Before storing in memory, Representation 1 is transformed into Representation 1*. When the data information is to be printed to the target medium, the data information is printed as Representation 1*. For example, a web page containing hyper text mark-up language may be captured, the hyper text markup language web page may then be stored as a bitmap image.

In the second exemplary transform shown, a second transformation operation is applied to the data information to produce Representation 1 before the data information is printed to the target medium. When the data information is printed to the target medium 107, the data information is printed as Representation 1****. In this exemplary transformation, two transformations occur. One at the scanning process, and a second at the printing process.

The transform Representation 1** can include any number of options such as, printing black and white, bolding, underlining, translating values, resealing, metadata rendering, or any other known or later developed method of transforming data information.

For example when a customer browses Web ads for wines of the world the selected wine name, merchant and price information of interest is printed into a paper notebook in accordance with the invention. A monetary transformation may automatically translate all non-U.S. monetary values into corresponding U.S. dollars before pasting.

In another example according to an exemplary embodiment of this invention, a customer browsing Web ads for wines of the world and designates specific data information to be pasted into a paper notebook or a Post-It® style paper. However, if the target image space 105 where the captured data information is to be printed is smaller than the source image space 103 where the captured image was captured from, then the print font size is adjusted to fit the smaller area. Alternatively, if the target image space 105 where the captured data information is to be printed is larger than the source image space 103 where the image was captured from, then the printed font size is adjusted to fit the larger area.

In another example, a user has a map of a country with various locations that the user would like plan to visit various friends. The user can organize and plan his visit by adjusting and fitting the phone numbers of his friends and the dates of his planned visit into a target image space 105 corresponding to the various friends' locations on the map.

A user can transform, for example, recipe data information to fit recipes in a diary or onto recipe cards and/or ingredients on a shopping list.

As data information is captured, it is oftentimes desirable to print meta-information stored in the printer, such as, for example, a current date, a current time, a name, an email address, a bar code identifying the captured information. It may also be desirable to further transform the stored content, once it has been captured, to take advantage of particular output specification sources, such as for example, size, shape and format, or any other known or later developed type of output specification.

Metadata rendering is another example of a transformation that can be used in combination with the position-aware freeform printing system 2. Each element that is printed with the printing device and/or scanned into the printing device is assigned a unique identifier. At the user's request, this identifier is printed along with the content as a barcode or other identifier. The barcode may be a one; two or multidimensional barcode or any other known or later developed identifier. By scanning this identifier, the user can retrieve properties associated with the identifier. Example properties that can be included in matadata are for example, the content of the data information itself, the date, the time, the link to the source from where the content was selected, or any other known or later developed data information. After scanning an identifier, the user can print data information referenced by the identifier elsewhere. The user can also send the entire identifier or properties associated with the identifier to host computers like PDAs, cellphones, etc. using any known or later developed communication techniques.

For example, metadata comprises any number of different attributes, including but not limited to, indicating where the particular data information was obtained from, the date the data information was captured, what the particular data information relates to, how often the data information has been printed, what transformations have occurred to the data information, including the content selection or any other known or later developed attribute or property with the data information. Metadata includes, for example, file information, the author, the title, the URL location from which the data information was clipped from or any other source identifier. By scanning the bar code, metadata associated with the bar code can be easily transferred to another medium. In accordance with the invention, metadata expands beyond mere association to a file system.

Once a particular target image space 105 has been defined, subsequent printing operations to a target image space 105 similar in dimension to the first target image space 105 do not need to be re-defined again since the previous processed printing instructions are identical to the subsequent printing operation. These previously defined dimensions may be easily referenced for future use by selecting the appropriate metadata attributes.

As shown in FIG. 6, a fourth freeform printing usage situation is "segmentation." The user may be interested in segmenting the captured print content into different printable aspects. This captured print content is processed in an intermediate form. Specifically, only selected portions of the source content is captured. Segmentation of the content prior to print includes, but is not limited to, filtering, cropping, attribute extraction, such as, text only, edges only and resolution reduction or any other known or later-developed method of segmenting captured print content.

In the fourth segment operation, data information is captured as Representation 1, stored in memory and segmented into Representation 1 to Representation N. When the data information is to be printed to the target medium in a printing mode, the data information is printed as segment Representation 1 to Representation N.

For example, a user can capture the "Coke" logo and then segment out each letter separately. When the logo is to be printed to the target medium in a printing mode, each of the letters is printed separately, such as, C . . . O . . . K . . . E. In this way, the original representation is segmented.

For example, when a customer browses Web ads for wines of the world, interesting data information is printed into a paper notebook. However, before printing, the position-aware freeform printing system 2 extracts the text using optical character recognition, and prints the recognized segmented text in a standard font.

A video stream is another example of data information that can be segmented using the position-aware freeform printing system 2. A video is segmented and represented by a plurality of picture frames. In accordance with another exemplary embodiment of this invention, representative video frames from the video sequence may be selected and a collage made of the selected frames by printing the selected frames in a two dimensional area. The selected video frames can be presented in different sizes based upon the importance of the frame or any other attribute of the selected video frame.

In various other exemplary embodiments according to this invention, segmentation may include Z-axis printing or graphic layering. In Z-axis printing, or graphic layering, the print head is controlled in such a way that the printed content may underlay or overlay pre-existing content. The image to be printed is segmented into various separate layers that may be printed separately. Examples of Z-axis printing include, but are not limited to, underlining, bolding and highlighting text which has been previously printed. The user may select information to emphasize using a gesture motion or any other known or other known or later developed method of selecting data information.

A gesture motion may be used to identify data information that is to be printed by making a particular gesture affecting at least a portion of image content, such as, by handwriting, overwriting, circling, highlighting, or any other known or later-developed type of gesture motion. An inferred gesture motion can be detected, for example, by tracing over the same location repeatedly. In various other exemplary embodiments according to this invention, selection of emphasis can also be applied through a tool palette, or explicit selection through physical means including, such as changing pens, and/or using control surfaces on the pen such as buttons grip sensing, or any other known or later-developed input method.

The fifth free-form printing usage situation shown in FIG. 6 is "aggregation". Aggregation occurs when multiple data information for multiple images are accumulated. For example, a user may wish to aggregate multiple source images of data information before printing. In particular, content from multiple sources may be accumulated and placed into one piece of paper using the position-aware freeform printing system 2. The image processor of the position-aware freeform printing system 2 takes the separately captured content from multiple source image spaces 103 and reformats the aggregate content to fit the target image space 105. The captured content can be pasted after numerous segments have been captured as a single aggregate. This may include simple concatenation, selecting non-contiguous words in a text document with a highlighter and aggregating these fragments before they are printed or resizing or reflowing the content through various layout methods, a grid, a table, a best fit, or any other known or later-developed layout and/or formatting method.

Data information is captured during the aggregate operation as Representation 1 to Representation N, stored in memory and aggregated by a transformation such as concatenation. The result is stored as Representation 1* in the intermediate stage. When the data information is to be printed in the target image space 105 of the target medium 107, the data information is printed as aggregate Representation 1*.

For example, a user may capture the "Coke" logo separately as a "C", an "o", a "k", and an "e." The separately captured data information, "C", "o", "k", and "e" are represented as Representation 1 . . . Representation N. The user may then aggregate the letters using a transform operation such as concatenation as discussed above to generate Representation 1*. Representations 1 . . . Representation N representing the "C" "o" "k" "e" will be aggregated and printed out as a single data information, such as "Coke."

In various other exemplary embodiments according to this invention, a customer browses Web ads for wines of the world. As each product of interest is found, the customer highlights this data information in a source image space 103 and captures the data information into the information storage unit 110 of the position-aware freeform printing system 2. After a desired number of items from various source image space s 103 have been captured and processed. The items of particular interest, including summary information are printed into target image space 105 in the customer's paper notebook. For example, the printed material may read, "Item 4 of Veuve Cliquot; $35; Total so far: $250." The item name and price are taken from the original content of the source image space 103 and the item list and the total are determined as the product of the aggregated data information. Alternatively, a user may collect multiple sales vendors phone numbers and related sales data information while browsing for consumer items on the Web.

In various other exemplary embodiments according to this invention, a user is able to easily record data information as the user searches. For example, as the user browses the Web with the printing device of the position-aware freeform printing system, the user can easily capture data information of interest, such as, phone numbers, apartment type, number of bedrooms, or any other type of data information by determining a source image space 103 for each item of interest. After the desired number of items defined by source image spaces 103 have been captured and processed, the items of interest, including summary data information, are printed onto a printable medium. For example, data information may include how many apartments have been recorded or any other information. The position-aware freeform printing system 2 allows a user to collect data information of interest to the user. By capturing and aggregating only data information of interest, the amount of data information that the user will have to review is minimized.

Any combination of the above listed freeform printing usage situation can be combined. For example, a user may wish to combine aggregation, segmentation, and transformation operations.

In various other exemplary embodiments according to this invention, data information may optionally be captured in an information capture unit 100 while in a non-printing mode. Alternatively, an optional software layer can be installed to run in, or in cooperation with, a graphical user interface. The software layer allows users to select data information on a display that is to be captured and printed with predefined shapes like rectangles, ellipses or with undefined shapes, such as by specifying a freeform shape with the printing device. Depending on user's interest, the software then transmits either the data information as a bitmap to print or can process the data information so as to extract the textual data information. However, it will be apparent that the position aware freeform printing system 2 may be used with images obtained from any source or using any known or later developed method.

In another alternative embodiment according to this invention, the position-aware freeform printing system 2 can be equipped with a CCD camera for capturing pictures. The position-aware freeform printing system 2 can also be adapted to directly interact with personal computers, PDAs, cell phones, or any other processing capable devices such that these devices communicate the selected data information with the position-aware free-form printing system 2 via wired and wireless technologies. For example, a Bluetooth® and/or infrared communication, transmitting data information through serial lines or communication networks or any other known or later developed communication technique may be used without departing from the spirit or scope of this invention.

Data information can also be captured and processed by scanning in printed forms of content, including but not limited to, optical character recognition, glyph recognition, bar code scanning or any other known or later developed modes of capturing data information.

The data information can be displayed on a screen such as the screen of a Personal Computer, PDA or Cell Phone, or TV screen or encoded on the screen using a flashing light to encode information to be sent to the controller. Alternatively a bar code which can be easily scanned by a photo sensor on the printing device. Similarly, audio tones from a computer speaker can be used to encode data information to be sent to the controller. However, it will be apparent that any other method of information encoding such as by, facsimile, modem, ad hoc encodings or any other known or later developed method may be used to send the data information to the controller.

Any number of data information storage techniques is appropriate for the information storage unit 110 of the position-aware freeform printing system 2. For example, local or server-based databases or files, memory cards, or any other known or later developed type of storage unit. The data information captured by the information storage unit 110 can be stored either in the printing device 101 itself, in a remote storage medium such as a personal computer, or any other known or later developed device for storing data information.

In addition, metadata management may be performed by the metadata input/output unit 115. In particular, metadata management is useful for identifying and maintaining links to the original content. For example, URLs, filenames, authors, date/time or any other known or later developed links to original content may also be saved as the information is captured. As the image processed for printing, it may be desirable to keep the links to the original content available as metadata. The metadata may be extracted from tag information printed with the content, such as dataglyphs and bar codes or any other known or later developed mode of storing metadata. In various other exemplary embodiments, the metadata may be extracted by a direct query of the data information stored. Query by date, time, content source, person who captured the data information or any other stored information or information attribute may be accessed. Depending on user preferences, metadata could be printed along with the data information itself. Metadata tags enable a user to quickly and easily go back to the source, like a Web page, from which a particular text has been extracted.

In accordance with the invention, the surface-head tracker 160 tracks the position of the freeform print head 150 in real time. The surface head tracker 160 determines a particular location of the print head in real time. The surface head tracker 160 signals to the image processor 120 through metadata input/output unit 115, which direction the print head 150 is traveling. The image processor 120 compensates in real time as the print head 150 is moved in a freeform motion. Any surface head tracking techniques capable of determining the position of the print head 150 of the printing device 101.

If the print head contains only one printing element (one dot), then only (X, Y) coordinates are necessary to drive the print head 150. However, printing one dot at a time would require much time and precision to print a single picture. In various other exemplary embodiments according to this invention the print head 150 may contain an array of printing elements, a linear array or any other known or later developed combination of printing elements.

Stream tracking information, for example, X, Y and alpha information is supported by the surface head tracker 160. The location of the print head of the printing device 101 is used to determine corresponding print values of the processed print image. These values are used to command the print head 150 of the printing device 101. For example, on and off commands may be used with a single color print head 150. Corresponding print values may be determined, for example, by comparing the input values to a look up table, and/or processing by predetermined algorithms and/or processing the input values in real time to obtain the print values. In stream tracking, X, Y and alpha values are derived to determine the direction of the print head. Actual corresponding pixels are retrieved from memory to determine where the print head is to print. For example, when a touch screen device is incorporated with the print head 150 (having seven dots), alpha is defined as the orientation of the printer. By knowing the value for alpha, the position of each of the seven dots of the print head 150 can be located. Thus, by determining the X, Y and alpha value, the exact location of each of the seven pixels can be determined.

In another exemplary embodiment according to this invention, a print head with multiple inkjet ejector nozzles that can print the height of at least one character may be provided. However, it will be apparent that the printing device may take many forms depending on the type of print material. The printing device mechanism may include, a dot-matrix printer, an ink-jet printer, a stamp, a pen, a magnet, a thermal printer, or any other known or later developed printer mechanism.

Figure 7:
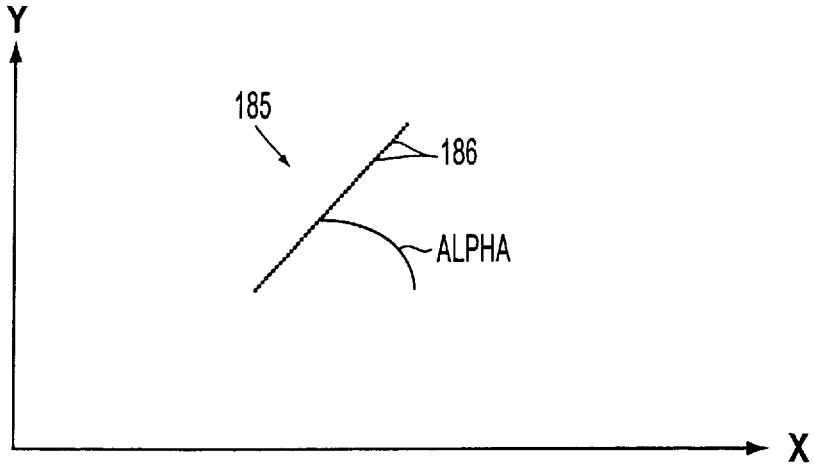
FIG. 7 shows a plot of the print head location versus the orientation sensing in accordance with this invention.

FIG. 7 illustrates an exemplary embodiment for a print head location and orientation sensing of a linear array 185 of printing elements to be used in accordance with the invention. When the print head 150 is moved over a flat surface, for example, the X, Y plane in FIG. 7, each dot or individual printing element 186, can only move horizontally, in the X direction, or vertically, in the Y direction. However, when the linear array 185 of printing elements is used to determine the location and orientation of the print head, knowing the position of two printing elements 186 is sufficient to determine the position of all other elements 186 in the linear array 185. If the position of one printing element 186 is known, a direction alpha can be sampled, for example, by an accelerometer, a compass or any other known or later developed device for detecting the position of the print head 150, to determine any one particular dot or printing element 186. The position of the print head 150 may be sensed as a single point, a single point with an orientation angle, or as multiple points (X1, Y1) to (Xn, Yn). Electromagnetic tablets, ultrasonic sensors or any other known or later developed position sensing hardware may be used to sense the print head position.

It will be apparent that any position sensing technique may be used in the practice of this invention including, but not limited to, electromagnetic location sensing, touch sensitivity, line of sight triangulation device, inertial calculation using accelerometers, dataglyphs, or any other known or later developed position sensing technology.

In contrast to mechanical and optical tracking mechanisms, the use of a location sensing area technique provides for simplicity, accuracy and independent location positioning. The position sensing devices provide an independent and absolute coordinate system that allows for freeform printing on the printable material placed on the sensed surface.

The user can also specify the coordinate system through a gesture using the printing device in a non-printing mode. For example, the user may make a horizontal motion that is used to indicate the X axis. The Y axis is then defined by the perpendicular direction to the calculated X axis. The origin could be anywhere along the X axis, depending on convenience for the user and the printing task. For example, the origin may be implicitly calculated at the middle of either extreme of the X axis gesture, implicitly by extending the X axis to the extreme or middle of the position sensed area, or by an explicit user gesture to indicate the origin such as by a tick mark anywhere along the X axis. A user can also indicate the orientation of the data information by dragging the printing device in a non-drawing mode. The non-drawing mode defines the X axis, and the Y position is defined as the perpendicular direction to the X axis. In various other exemplary embodiments according to this invention, the X axis direction may be a wave line such that text is printed along the baseline defined by the wave line and the Y axis direction is perpendicular to the X axis direction at each X-coordinate position.

In various other exemplary embodiments of the position-aware freeform printing system 2, the position determining may use electromagnetic signals. For example, in the IBM CrossPad®, a special pen is used to draw on a notepad containing paper sheets. Under the notepad containing the paper sheets is a CrossPad® tablet. As the pen is moved over the paper sheets of the notepad, the pen sends an electromagnetic signal to the tablet indicating the location of the pen. The tablet sends the position back to the pen, which could then print the corresponding pixels on the surface.

Figure 8:
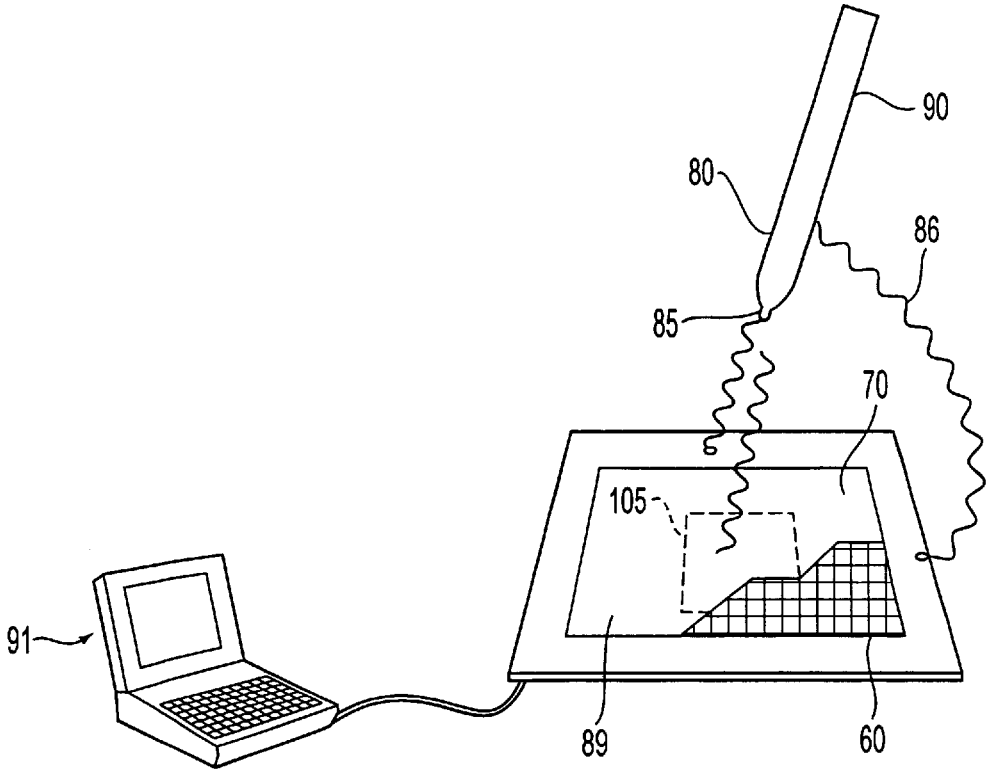
FIG. 8 shows an exemplary embodiment of a location tablet sensing position-aware freeform printing system in accordance with this invention.

FIG. 8 shows another exemplary embodiment of the position-aware freeform printing system. A magnetic tablet 60 is overlaid by a position sensing tablet 70 used to sense position. A printing device 90 with a mounted magnetic probe 80 is swiped over a surface of the magnetic tablet 60 in a freeform manner to print data information previously copied from source image space 103 onto the magnetic tablet 70. The printing device 90 selectively attracts magnetic ink in the magnetic tablet 60 to a visible position thereby building up a desired image.

The tip 85 of the mounted magnetic probe 80 of the pen-like device may contain only one dot or a single printing element so that an image is not always printed in one freeform swipe. However, as mentioned above, in various other exemplary embodiments according to this invention the print head may have an array of printing elements, a linear array or any other known or later developed combination of printing elements. Therefore, users will move the printing device 90 over the surface of the magnetic tablet 60 in a freeform manner to print the image. The magnetic tablet 60 tracks the position of the magnetic probe 80 over the surface of the magnetic tablet 60. When the entire area of the target image space 105 of the target medium 89 has been traversed in a freeform manner, the image will be printed.

Also, in various other exemplary embodiments according to this invention, touch sensitivity may be used to determine the position of the tip 85 of print head 150 of the printing device 101 by reporting a location in direct contact with a touch sensitive surface. However, as discussed above, it will be apparent that any mode of determining the position of the tip of a print head may be used in the practice of this invention.

FIG. 9 shows a touch sensitive location position sensing device according to another exemplary embodiment of the position-aware freeform printing system 2. In the touch sensitive device 260, physical contact of the printing device 290 with a touch sensitive surface 220, such as a touchscreen or a touchpad, is used to drive the printing device 290. Accelerometers (not shown) are placed in the printing device 290 to detect the orientation of the print head 280 and for capture of emphasis gestures. A target medium 270, such as paper, is placed on the touch surface 220 for printing thereon. A target image space 205 is specified by a user tracing the intended target image space 205 before printing in a freeform manner with the printing device 290. All processing can take place in the touch sensitive device 260 or in an attached computer (not shown).

FIG. 10 shows a third position determining technology to be used in accordance with the position-aware freeform printing system is determined by line of sight triangulation techniques. The N-Scribe™ pen uses a triangulation technique to determine its position relative to a base position. To use the pen, the cover is removed and attached to whatever surface is to be written on. The pen emits infrared light which is received by two infrared sensors in the pen cover. Together, the pen and sensors, constantly report the location of the pen in relationship to the two fixed points.

In particular, FIG. 10 illustrates one embodiment for a line of sight triangulation position determining device to be used in accordance with the position-aware freeform printing system. In the line of sight triangulation position device 360, a line of sight transmitter 386, such as an infrared transmitter or an ultrasonic transmitter, is attached to the freeform printer 390. The signal is picked up by receivers 387 and a location is calculated, for example, a time difference of arrival, to drive the printing device 390. Accelerometers (not shown) are placed in the printing device 390 to detect the orientation of the print head 380 and for capture of emphasis gestures. The target medium 307, such as paper, is placed in the field of view of the receivers. For example, the target medium 307 may be placed horizontally on a drafting table or vertically on a white board. The target image space 305 is specified by the user tracing the intended target image space 305 before printing. All other processing can take place in an attached computer 391 such as a personal computer, a laptop, a palmtop and a PDA or any other known or later developed device capable of processing data information.

In various other exemplary embodiments according to this invention, inertial location calculations using accelerometers may be used to determine the position of the print head 150 of the printing device 101. For example, the SmartQuill® pen can be used in combination with the position-aware freeform printing system. The SmartQuill™ pen uses an accelerometer chip to determine its position at any time. Positions can also be obtained even if the pen is not physically pressed onto a surface, but manipulated in the air.

Dataglyphs 399 may also be used to determine the position of the print head 150 of the printing device 101. FIG. 10 shows dataglyphs 399 being used to determine the position of the print head 150 of the printing device 101. Address carpets are specifically designed to provide the absolute position over a target medium, such as paper. Dataglyphs 399 can be printed with invisible, magnetic or normal inks. A special glyph-reader consisting of a CCD camera is used to scan the glyph codes. Very high locations can be detected, for example, up to 1 micrometer. By using dataglyphs in combination with the position-aware freeform printing system, absolute orientation of the X and Y axis can be determined. In accordance with this aspect of the invention, a user can choose not to use the default orientation provided by the location-sensed area and instead indicate a new orientation by dragging the printing device 101 in the non-printing mode. This direction defines the X axis, and the Y axis is defined as the perpendicular direction to the X axis. For example, the user may draw a shape from left to right which will determine the X direction. The Y direction need not be drawn but may be determined perpendicular to the X direction.

A variety of techniques may be used to process the data information in the image processor 120. For example, informal printing of data information in the context of existing data information involves resealing and reshaping the original data information so that the data information fits into a target image space 105 of a target medium 107. In another aspect of the invention, warping the data information around a predetermined path may be performed. Image processing attributes, such as defining a new width, a height or a shape of the data information is stored as attributes associated with this data information. Because these attributes may be stored, users can print new data information with previously defined attributes. For example, users will not have to redefine the size of the target image space 105 every time they need to print in the target medium 107.

Any processing technique can be applied in accordance with the position-aware freeform printing system 2, such as brightness adjustment, contrast and color adjustments which can be applied by the position aware free-form printing system 2 or on a host computer before the data information is printed.

Referring again to the image processor 120 in FIG. 3, additional image processing in the image processor 120 may be used to prepare a captured source image space 103 to fit a target image space 105 by aggregation, segmentation and transformation of the data information. Processing may also be implemented when emphasis is applied to print, for example, bolding, underlining or changing text or any other known or later developed type of processing. Also, installed software installed in or run in cooperation with a graphical user interface may be used to introduce registration marks for aiding data information capture of the underlying content, the extraction and use of metadata requires image processing for creating, applying, and maintaining links to original content. Interface processing for Z-axis printing may also be performed so that the freeform printing occurs in selected layers indicated by the Z-axis information of stored print images. Real-time Image processing may also be used in predicting the print head position and adjusting the image to compensate for any motion such as bending a line of text around a corner.

FIGS. 11–15B describe, in greater detail, three exemplary image transformation according to an embodiment of this invention to transform images in the image processor 120. The image transformations include, but are not limited to, 1) specifying the dimensions of the printed area, 2) specifying the layout of the printed data information and 3) warping text around an arbitrary path.

In accordance with one embodiment of this invention, the first image transformation technique is specifying the dimensions of the printed area. The freeform printing device allows a user freedom in specifying the dimensions of the area where the data information is to be pasted.

For example, a user may specify the width and/or the height of the target image space 105 on the target medium 107, where the data information is to be pasted. In a non-printing mode, the user defines a target image space 105 by moving the printing device 101 over the surface of the target medium 107. The print area specifier 140 receives signals from the surface head tracker 160 to define the target image space 105. The print formatter 130 reformats the data information so that the data information fits into the target image space 105 on the target medium 107. In a second pass and in a printing mode, the user moves the printing device 101 over the predefined target image space 105 and prints the newly formatted data information. If the captured data information in step 100 is a picture, the corresponding bitmap may be stretched according to the area of the predefined target image space 105.

Figure 11:
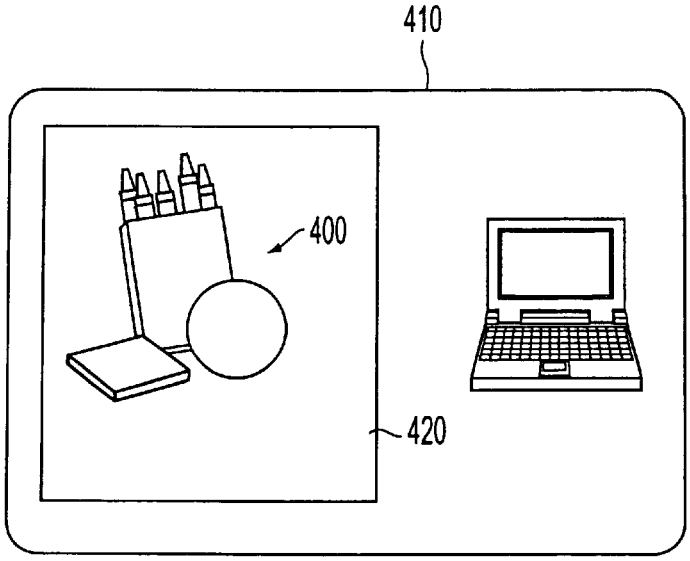
FIG. 11 shows an image selection from a source image space according to this invention.

FIG. 11 show an image selection from a source image space 420 according to this invention. In a non-printing mode, a user selects data information 400 to print from a source medium 410. Source medium 410 may include any medium, such as a computer screen or any other known or later developed medium. The source image space 420 surrounding the data information 400 is defined by strokes of the freeform printing device as discussed above. The data information 400 is captured and saved into a memory storage unit in the position aware freeform printing system 2.

Figure 12:
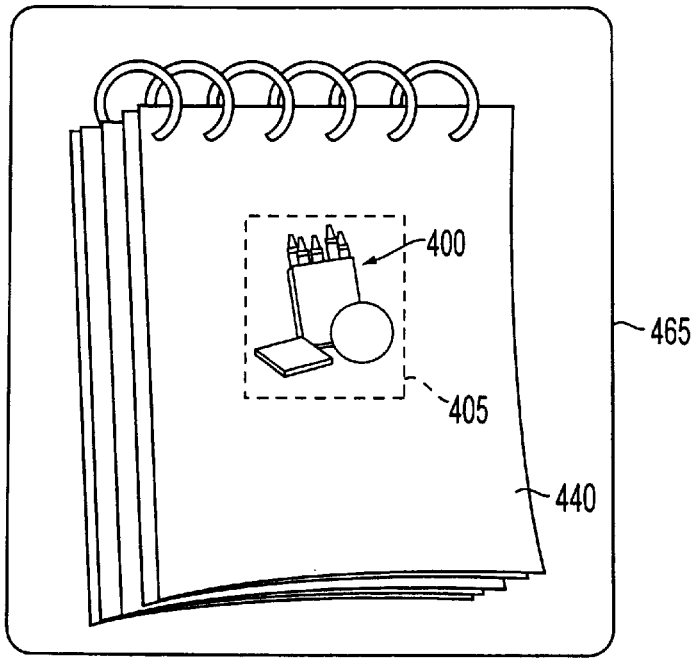
FIG. 12 shows an exemplary selected image rescaled to fit within a target image space according to this invention.

FIG. 12 shows the exemplary image rescaled to fit within a target image space 405 according to this invention. A new target image space 405 may be specified on a target medium 440, such as a notebook, by dragging the printing device over the target medium 440. The target image space 405 is not limited to square or rectangular shapes and can include any size or shape specified by the printing device. If the target image space 405 is defined as a dimension different from the dimension of the source image space 420 of FIG. 11, the date information 400 will be reformatted, such as by rescaling the width and height of the data information 400, to fit the target image space 405. Then, in a printing mode, the user prints the image 400 into the predefined target image space 405 in a freeform manner. The data information 400 is transferred to the target image space 405 of the target medium 440 as the print head (not shown) traverses the area of the target image space 405 as determined based on position information from a position sensing device 465.

For example, if the data information is textual, the printing device can reformat the text font size so that all of the textual data information fits into the target image space 405. The font size may be changed and/or lines may be split and printed on several lines as required. Words may be appropriately split so that they are not fragmented at the end of each line. For non-textual data information, the non-textual data information may be resized and/or rescaled to fit the target image space 405.

Figure 13:
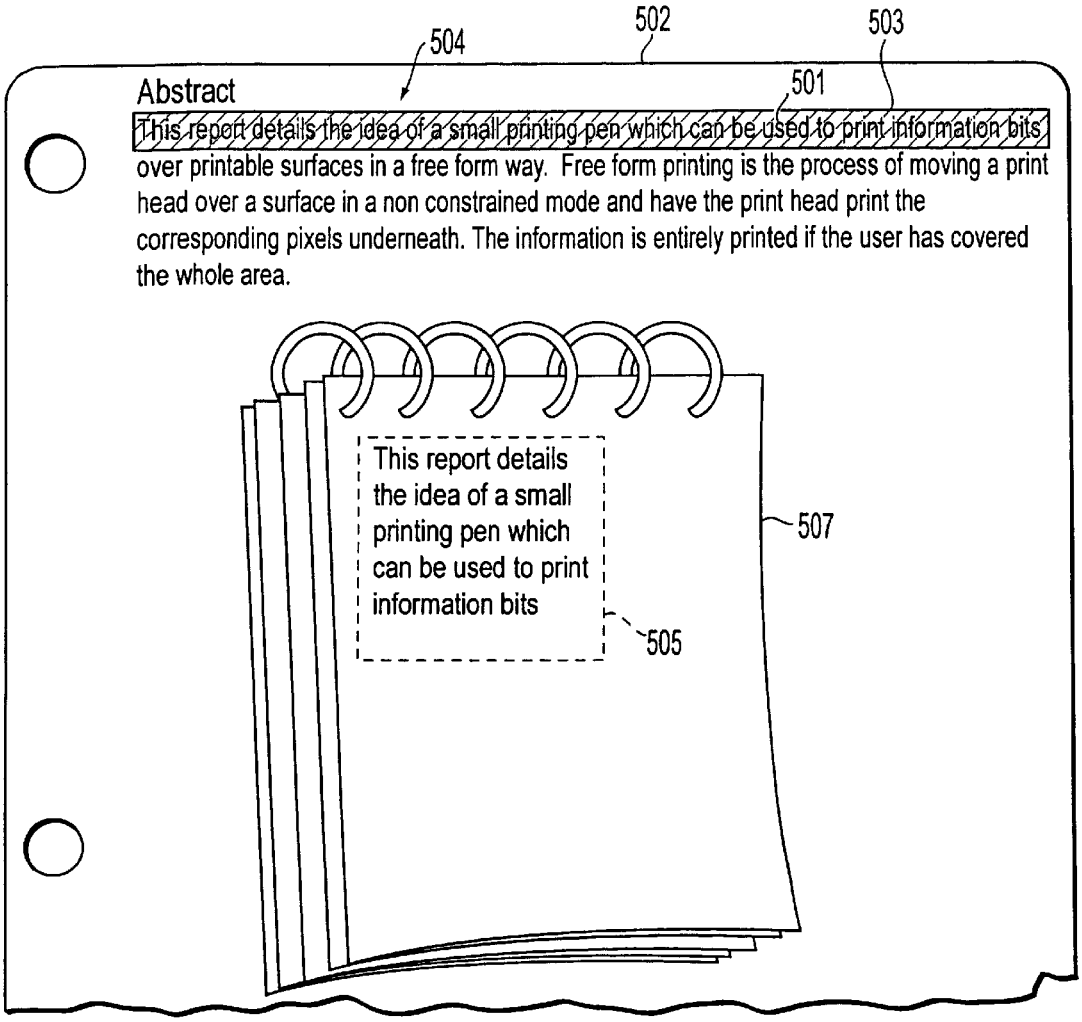
FIG. 13 shows an exemplary printing of a selection of text from a source medium into a target medium according to this invention.

FIG. 13 shows an exemplary printing of a selection of text from a source medium 502 into a target medium 507 according to this invention. Text 501 from source image space 503 of source medium 502, is selected to be copied, to a target image space 505 in a target medium 507, such as a notebook.

A source image space 503 is defined by highlighting the source image with a mouse or by using any other known or later developed method to select text 501. The selected text 501 may be captured by a scanner, copied from a personal computer or any other device capable of creating, capturing and/or storing the selected text. The selected text may then be transferred to the position aware freeform printing system 2. A new target image space 505 is specified on the target medium 507 by dragging the printing device over the target medium 507. The target image space 505 is flexible and is not limited to any one particular shape. For example, the target image space 505 is not the same size as the area of the source image space 503. Therefore, before printing the selected text 501 of the source image space 503 into the target image space 505, the text is reformatted to fit the target image space 505. Reformatting the text may include, for example, rescaling the width and height of the text to ensure that all the words fit onto a single line. In a printing mode, the text 501 is printed into the target image space 505 in a freeform motion. The text 501 is transferred to the target image space 505 of the target medium 507 as the print head of the printing device moves over the area of the target image space 505.

In accordance with the invention, the second image transformation technique is specifying the layout of the printed data information. In addition to specifying the overall dimension, for example, the width and the height, of the data information to print, in some applications it is desirable to specify the freeform area.

In addition to specifying a print layout such as height and width, a freeform area may be specified. For example, a freeform area may be used to specify where a user may warp text around pictures and/or insert captured data information into the context of existing data information. Therefore, it is another aspect of the invention, to allow a user to insert captured data information onto a target medium with preexisting data information printed thereon. For example, the open areas surrounding notes written on a notebook or open areas on a calendar containing preprinted data information may be printed with additional data information. The preprinted data information can be identified in a number of ways, such as, by underlining, bolding, or highlighting preexisting data information. Since the space available to print the data information is not necessarily a rectangle, one solution is to use a two pass printing process as previously done to specify the dimension, such as the width and the height, of the data information to be printed. A user may specify the shape of the data information to be printed before it is actually printed. In particular, the user moves the printing device over the target image space where the data information is to be printed. A surface head tracker 160 of the printing device 101 records the target image space as the printer is moved over the surface of the target medium 107. When the target image space has been defined, the data information is reformatted to fit into this predefined area.

In another embodiment of the system for position aware freeform printing according to this invention, the locations such as X, Y locations that have been printed are stored and further printing to the stored locations inhibited.

Figure 14:
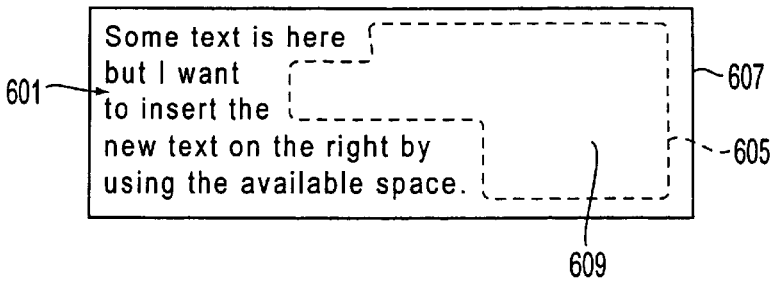
FIG. 14 shows an exemplary target image space according to this invention.

FIG. 14 illustrates one embodiment of specifying a shape where the captured data information is to be printed according to this invention. This image transformation technique is useful both for reformatting by reshaping pictures and for transforming textual data information to be printed within a defined target image space 105.

A user can insert captured data information onto a target medium 607 having pre-printed material 601 printed thereon. The captured data information can be inserted in open spaces 609 surrounded by the pre-printed data information 601. The preexisting data information may be written, for example, on a notebook or in open areas on a calendar having pre-printed data information. In FIG. 14, the open space 609 is not necessarily a rectangle. Therefore, the user may specify the freeform shape of the target image space 605 where the captured data information is to be printed in the open space 609. The shape is specified when the user drags a printing device in the open space 609 along a desired path defining the target image space 605. A position sensing device of the printing device records the defined target image space 605 as the printing device is dragged along the desired path that defines the target image space 605. When a print mode is selected to print the captured data information to the target image space 605, the captured data information will be reformatted to fit into the predefined target image space 605.

Alternative image transformations also include allowing a user to specify a path where the data information is to be warped.

Figure 15A:
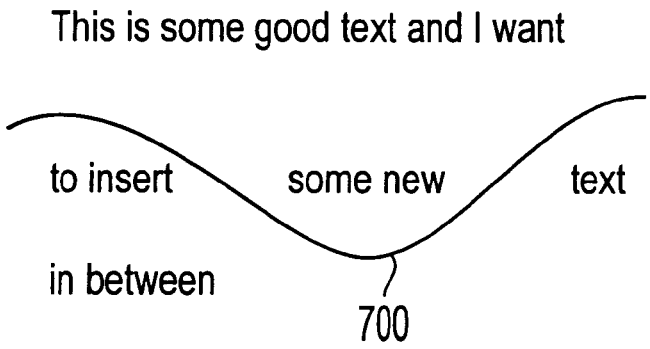
FIG. 15A shows defining a freeform shape for warping text along a freeform path according to this invention.
Figure 15B:
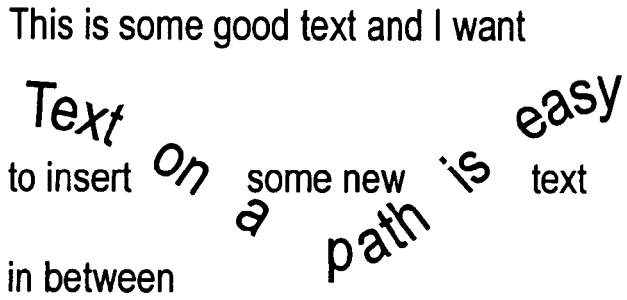
FIG. 15B shows warping text along the path of the freeform shape according to this invention.

FIGS. 15A and 15B shows warping text along a path defined by a freeform shape 700 with a print head having multiple inkjet ejector nozzles that can print the height of at least one character. Freeform warping of text includes, but is not limited to, two-pass text warping, real-time warping or any other known or later developed type of warping.

In a two-pass text warping mode, the captured text is printed in two passes. Referring again to FIGS. 15A and 15B, in a non-printing mode, the user first drags a printing device 101 to define a freeform shape 700. Once the position and shape of the freeform path is defined and recorded, the printing device reformats the text so that the text will be warped onto the predetermined path so as not to interfere with the preexisting text. See, for example, FIG. 15B.

In real-time warping mode, only one pass is required. The image has already been previously captured and stored into memory. As the user moves the printing device 101 over the surface, the text is progressively mapped onto a freeform linear shape that is defined by the successive positions of the printer. By determining the last few positions of the printing device 101 and estimating the new position, text can be warped in real-time. For example, in real-time warping mode, the last three positions of the print head of the printing device 101 are detected and interpolated to predict the position that the print head is traveling toward. The resultant target image will be the warped text inside of the predetermined target area.

After the data information has been image processed for the target image space 105 in a non-printing mode, the printing device 101 is be activated by placing the printing device 101 into a printing mode and the data information rendered onto the target medium as discussed above. The printing device 101 may be lifted any number of times during printing since absolute position sensing is provided.

The systems and methods for position-aware freeform printing system 2 according to this invention may be implemented on a programmed general purpose computer. However, the systems and methods for position-aware freeform printing according to this invention can also be implemented on a special purpose computer, a programmed microprocessor or micro-controller and peripheral integrated circuit elements, an ASIC or other integrated circuit, a digital signal processor, a hardwired electronic or logic circuit such as a discrete element circuit, a programmable logic device such as a PLD, PLA, FPGA or PAL, or the like. In general, any device, capable of implementing a finite state machine that is in turn capable of implementing the flowchart shown in FIG. 4 can be used to implement the systems and methods according to this invention.

The various blocks shown in FIGS. 1 and 3 can be implemented as portions of a suitably programmed general purpose computer. Alternatively, the various blocks shown in FIGS. 1,3 can be implemented as physically distinct hardware circuits within an ASIC, or using a FPGA, a PDL, a PLA or a PAL, or using discrete logic elements or discrete circuit elements. The particular form each of the blocks shown in FIGS. 1,3 will take is a design choice and will be obvious and predicable to those skilled in the art.

As shown in FIGS. 1,3 the information storage unit 110 can be implemented using any appropriate combination of alterable, volatile or non-volatile memory or non-alterable, or fixed, memory. The alterable memory, whether volatile or non-volatile, can be implemented using any one or more of static or dynamic RAM, a floppy disk and disk drive, a write-able or rewrite-able optical disk and disk drive, a hard drive, flash memory or the like. Similarly, the non-alterable or fixed memory can be implemented using any one or more of ROM, PROM, EPROM, EEPROM, an optical ROM disk, such as a CD-ROM or DVD-ROM disk, and disk drive or the like.

The communication link 190 of FIG. 3 can be any known or later developed device or system for connecting the components of the position-aware freeform printing system 2. The position-aware freeform printing system 2 may include one or more of a direct cable connection, a connection over a wide area network or a local area network, a connection over an intranet, a connection over the Internet, or a connection over any other distributed processing network or system. In general, the communication link 190 can be any known or later developed connection system.

Further, it should be appreciated that the communication link 190 can be a wired or wireless link to a network. The network can be a local area network, a wide area network, an intranet, the Internet, or any other distributed processing and storage network.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A method for position-aware freeform printing, comprising:

selecting and capturing a source image in a source image space;

defining a target image space into which the source image will be transferred; and rendering a target image into the target image space in a freeform manner based on the source image and absolute position information, wherein the captured source image is adjusted to fit the target image space.

2. The method of claim 1, further comprising the steps of:

selecting the source image while the printer is in a non-printing mode; and rendering the target image while the printer is in a printing mode.

3. The method of claim 1, wherein defining the target image space further comprises:

defining a target image space dimension;

determining a target image space based on the source image space and the target image space dimension.

4. The method of claim 1, wherein a controller performs real-time text warping by predicting the direction of motion of a print head of the printing device.

5. The method of claim 4, wherein predicting the direction of the print head comprises detecting a motion previously traveled by the print head and adjusting the printed target image to compensate for the motion previously traveled.

6. The method of claim 5, wherein predicting the direction of travel is a function of a curve fit for at least one of: a location, a velocity and an acceleration.

7. The method of claim 1, wherein processing the source image applies an emphasis to the display of the target image.

8. The method of claim 7, wherein the emphasis is chosen from at least one of: a bolding, an underline and a highlighting.

9. The method of claim 7, wherein the emphasis is applied in a first freeform pass of the print head.

10. The method of claim 7, wherein the emphasis is applied in a freeform pass of the print head.

11. The method of claim 7, wherein the emphasis is selected modally.

12. The method of claim 7, wherein the emphasis is selected by a gesture of at least one of; circling an image portion, highlighting a source image portion and underlining a source image portion.

13. The method of claim 1, wherein the method for position-aware freeform printing transfers the source image to the target image space by performing at least one of: a copying operation, a sequencing operation, a transformation operation, a segmentation operation and an aggregation operation.

14. The method of claim 13, wherein the copying operation further includes capturing the source image and pasting the source image to the target image space of a target medium.

15. The method of claim 13, wherein the sequencing operation includes at least two source images from at least one source image space, and further comprising the steps of pasting the images sequentially to at least one target image space in a target medium.

16. The method of claim 13, wherein the transformation operation modifies a display attribute of the source image.

17. The method of claim 16, wherein the transformation operation further comprises the steps of:

modifying the display attribute of the source image; and printing the target image based on the modified source image.

18. The method of claim 13, wherein the segmentation operation further comprises:

segmenting the source image into an intermediate form;

processing at least one segment of the captured source image; and printing at least one segment of the captured source image to the target image space.

19. The method of claim 13, wherein the aggregation operation includes aggregating a plurality of images and pasting the aggregated plurality of images into the target image space.

20. The method of claim 13, wherein the aggregation operation includes aggregating characteristics associated with the images in the source medium and pasting a value representing the aggregated characteristics to the target image space.

21. The method of claim 1, wherein defining the target image space occurs in a non-printing mode.

22. The method of claim 21, wherein the non-printing mode is a default mode.

23. The method of claim 21, wherein the printing mode is selected by at least one of: a switch, a graphical user interface selector and a gesture.

24. A position-aware freeform printing system comprising:

a controller to select and capture a source image having a source image space, the controller defining a target image space and rendering a target image in the target image space in a freeform manner based on the source image and absolute position information, wherein the captured source image is adjusted to fit the target image space.

25. The system of claim 24, wherein the controller selects the source image while the printer is in a non-printing mode, and renders the target image while the printer is in printing mode.

26. The system of claim 24, wherein the controller defines a target image space dimension and determines the target image space based on the source image space and the target image space dimension.

27. The system of claim 24, wherein the controller performs real-time text warping of the image by predicting the direction of motion of a print head of the printing device.

28. The system of claim 27, wherein the controller predicts the direction of the print head by detecting a motion previously traveled by the print head and adjusting the printed target image to compensate for the motion previously traveled.

29. The system of claim 28, wherein the predicted direction of travel is a function of a curve fit for at least one of: a location, a velocity and an acceleration.

30. The system of claim 24, wherein the controller applies an emphasis to the display of the target image.

31. The system of claim 30, wherein the emphasis is chosen from at least one of: a bolding, an underline and a highlighting.

32. The system of claim 30, wherein the emphasis is applied in a first freeform pass of the print head.

33. The system of claim 30, wherein the emphasis is applied in a freeform pass of the print head.

34. The system of claim 30, wherein the emphasis is selected modally.

35. The system of claim 30, wherein the emphasis is selected by a gesture of at least one of: circling an image portion, highlighting a source image portion and underlining a source image portion.

36. The system of claim 24, wherein the system for position-aware freeform printing transfers the source image to the target image space by performing at least one of: a copying operation, a sequencing operation, a transformation operation, a segmentation operation and an aggregation operation.

37. The system of claim 36, wherein the copying operation further includes pasting the source image to the target image space of a target medium.

38. The system of claim 36, wherein the sequencing operation includes at least two source images from at least one source image space, and wherein the controller pastes the images sequentially to at least one target image space in a target medium.

39. The system of claim 36, wherein the transformation operation modifies a display attribute of the source image.

40. The system of claim 39, wherein the transformation operation modifies the display attribute of the source image and prints the target image based on the modified source image.

41. The system of claim 36, wherein the segmentation operation segments the source image into an intermediate form, processes at least one segment of the captured source image, and prints at least one segment of the captured source image to the target image space.

42. The system of claim 36, wherein the aggregation operation aggregates a plurality of images and pastes the aggregated plurality of images into the target image space.

43. The system of claim 36, wherein the aggregation operation aggregates characteristics associated with the images in the source medium and pastes a value representing the aggregated characteristics to the target image space.

44. The system of claim 24, wherein defining the target image space occurs in a non-printing mode.

45. The system of claim 44, wherein the non-printing mode is a default mode.

46. The system of claim 44, wherein the printing mode is selected by at least one of: a switch, a graphical user interface selector and a gesture.

47. A method for position-aware freeform printing comprising:

selecting and capturing a source image;

defining a target image space into which the processed source image will be transferred in a non-printing mode;

processing the source image based on at least one of a scaling, a warping, a fitting, metadata tagging, applying an emphasis, and a Z-axis printing;

displaying the processed source image in the target image space in a freeform manner based on absolute position information, wherein the captured source image is adjusted to fit the target image space.

48. A carrier wave encoded to transmit a control program usable for a position-aware freeform printing system to a device for executing the control program, the control program including instructions comprising:

instructions for selecting and capturing a source image having a source image space;

instructions for defining a target image space into which the source image will be transferred; and instructions for rendering the image into the target image space in a freeform manner based on absolute position information, wherein the captured source image is adjusted to fit the target image space.

49. A computer readable storage medium, comprising a computer readable program code embodied on the computer readable storage medium, the computer readable program code usable to program a computer to program a position-aware freeform printing system, comprising the steps of:

selecting and capturing a source image having a source image space;

defining a target image space into which the source image will be transferred; and rendering the image into the target image space in a freeform manner based on absolute position information, wherein the captured source image is adjusted to fit the target image space.

* * * * *